US006079377A

United States Patent [19]

Leijonberg

[11] Patent Number: 6,079,377

[45] Date of Patent: Jun. 27, 2000

[54] AIR COOLED POWER MACHINE

[75] Inventor: Gunnar Leijonberg, Huskvarna, Sweden

[73] Assignee: Gul & Co Development AB, Huskvarna, Sweden

[21] Appl. No.: 09/227,816

[22] Filed: Jan. 11, 1999

Related U.S. Application Data

[63] Continuation of application No. PCT/SE97/01260, Jul. 10, 1997.

[51] Int. Cl.[7] ..... F02B 75/26

[52] U.S. Cl. ..... 123/51 R; 123/52.2

[58] Field of Search ..... 123/51 B, 51 A, 123/52.2–52.5, 53.4, 53.6, 73 R, 73 AF, 73 PP, 74 A

[56] References Cited

U.S. PATENT DOCUMENTS 4,334,506 6/1982 Albert ..... 123/51 B

FOREIGN PATENT DOCUMENTS 1800103 3/1993 Russian Federation .

204220 9/1923 United Kingdom .

*Primary Examiner*—Marguerite McMahon

*Attorney, Agent, or Firm*—Pillsbury Madison & Sutro LLP

[57] ABSTRACT

The present invention is for the kind of power machine, engines, pumps or compressors which have two or more pistons which work against each other preferably with a common combustion space or corresponding in a stationary cylinder, and where the power is transmitted to or from a rotating motion without an intermediate crankshaft. Independent of whether the machine works as engine, pump or compressor there is a need to cool the cylinder. For applications such as engines for lawn-mowers and power saws the engines must be air-cooled as in practice it is not possible to arrange a water-cooling system. Cooling of the cylinder is obtained by that holes or channels are arranged both in the rotating and the stationary disc and cooling air is made to flow through these channels. In order to further improve the cooling the outside of the cylinder may have flanges. In other embodiments of the invention the connecting means between the rotating disc and the outgoing shaft are so shaped that they also function as fan blades and cause a desired air flow.

5 Claims, 5 Drawing Sheets

AIR COOLED POWER MACHINE

This is a Continuation of International Appln. No. PCT/SE97/01260 filed Jul. 10, 1997 which designated the U.S.

BACKGROUND OF THE INVENTION

The present invention is for the kind of power machines, engines, pumps or compressors which have two or more pistons which work against each other and preferably have a common combustion space within a stationary cylinder and where the power is transmitted to or from a rotating movement without an intermediate crankshaft.

Independent of wether the machine works as an engine compressor or pump there is a need to cool the cylinder bore. For certain applications such as engines for lawn-mowers and power saws these must be cooled by air as it in practice is very difficult or impossible to arrange a water cooling system.

In combustion engines the transmission of force from a to and fro (i.e., reciprocating) motion to a rotating motion generally is by means of some kind of crankshaft or the like. In certain cases however crankshafts are less suitable, and this is especially the case when to and from motions with different, often directly opposite directions together shall be transmitted into a rotating motion. Especially this is the case by that kind of power machines e.g. combustion engines, compressors or pumps, where two pistons at the same time work against each other in a common cylinder bore. In these cases the use of crankshaft bring with them complicating mechanical designs to put together the power from the two pistons into one common rotating motion. The transmission of force between a to and from motion and a rotating motion may instead take place using a ball bearing which runs in several tracks and includes a ball which is surrounded by a ball holder which is attached to one piston rod or the like member for each ball for transmission of the linear motion into rotating motion. It is also possible to exchange the balls for other means with corresponding functions, for example rolls or pins which roll or slide in the tracks.

One such device has two parallel plane discs both a stationary disc and one relatively thereto rotating disc. In a cylinder positioned centrally relative to the disc there are two pistons which are working pistons of a combustion engine, and have a common combustion space. Fixed to each piston there is a piston rod which at its opposite end has a holder means for the ball by which the force from the to and fro motion is transmitted to the rotating disc. The balls also serve as bearings between the stationary disc and the rotating disc. The rotating disc is mounted onto a holder which in turn is mounted onto an outgoing shaft from which the rotating force is taken for use for various driving purposes. The balls can move both in linear tracks in the fixed disc, and in a common elliptic or otherwise closed shaped track in the rotating disc. In other embodiments tracks may be substituted for by raised edges where roller or slide bearings contact the sides of the edges.

SUMMARY OF THE INVENTION

The present invention is for a machine as described above, where air-cooling of the cylinder is arranged. There are special difficulties in arranging air-cooling of machines of the above mentioned kind, because known power transmission designs have made it impossible to arrange a sufficient cooling air flow. The present invention offers a solution to this problem by a device with the characteristics which are mentioned in claim 1. Other embodiments of the device are described in the dependent claims.

DESCRIPTION OF THE DRAWINGS

The invention will below be described with reference to the embodiment which is shown in the enclosed figures.

DETAILED DESCRIPTION

Figure 1:
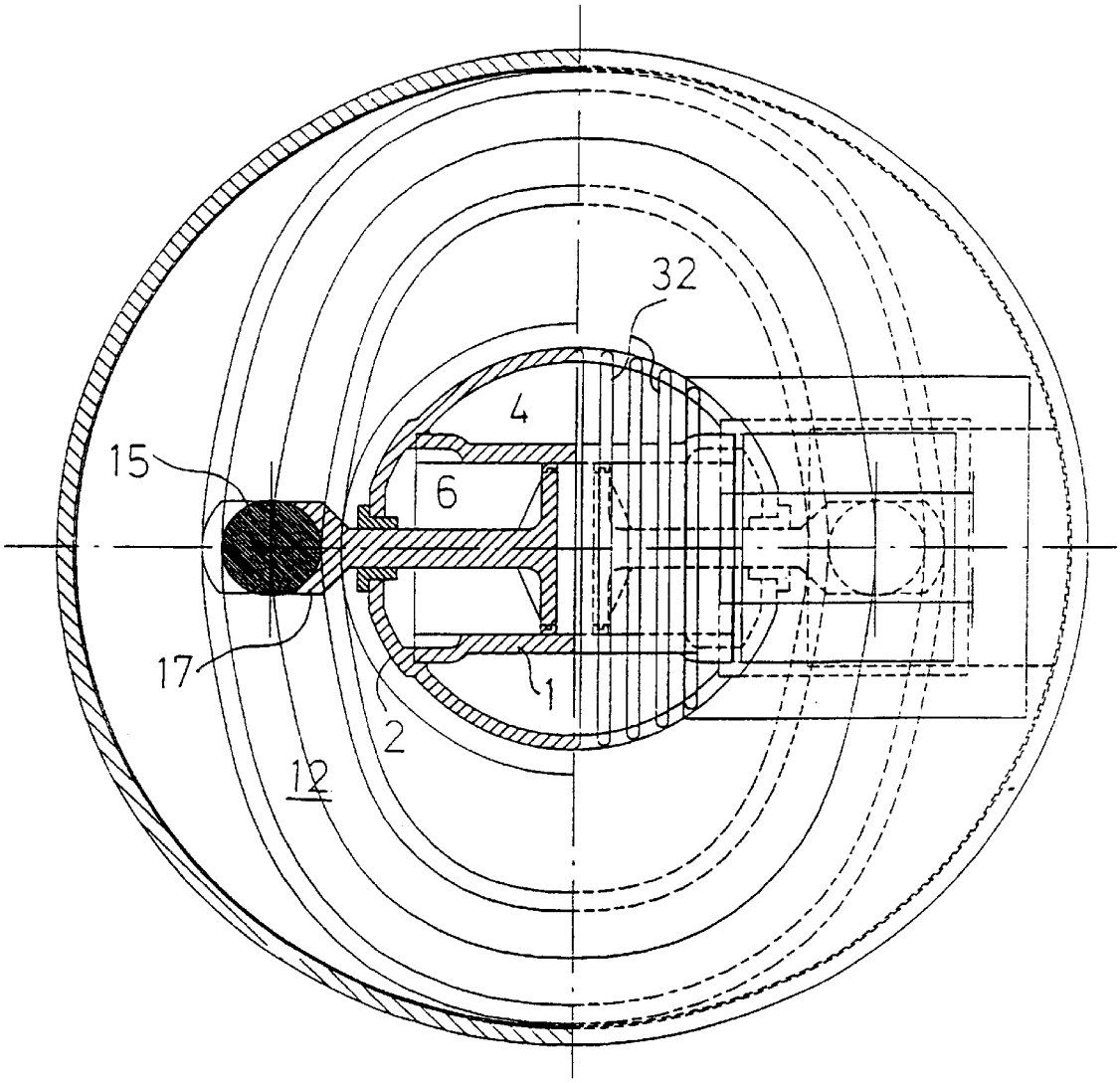
FIG. 1 shows a cross section of a machine according to the invention.
Figure 2:
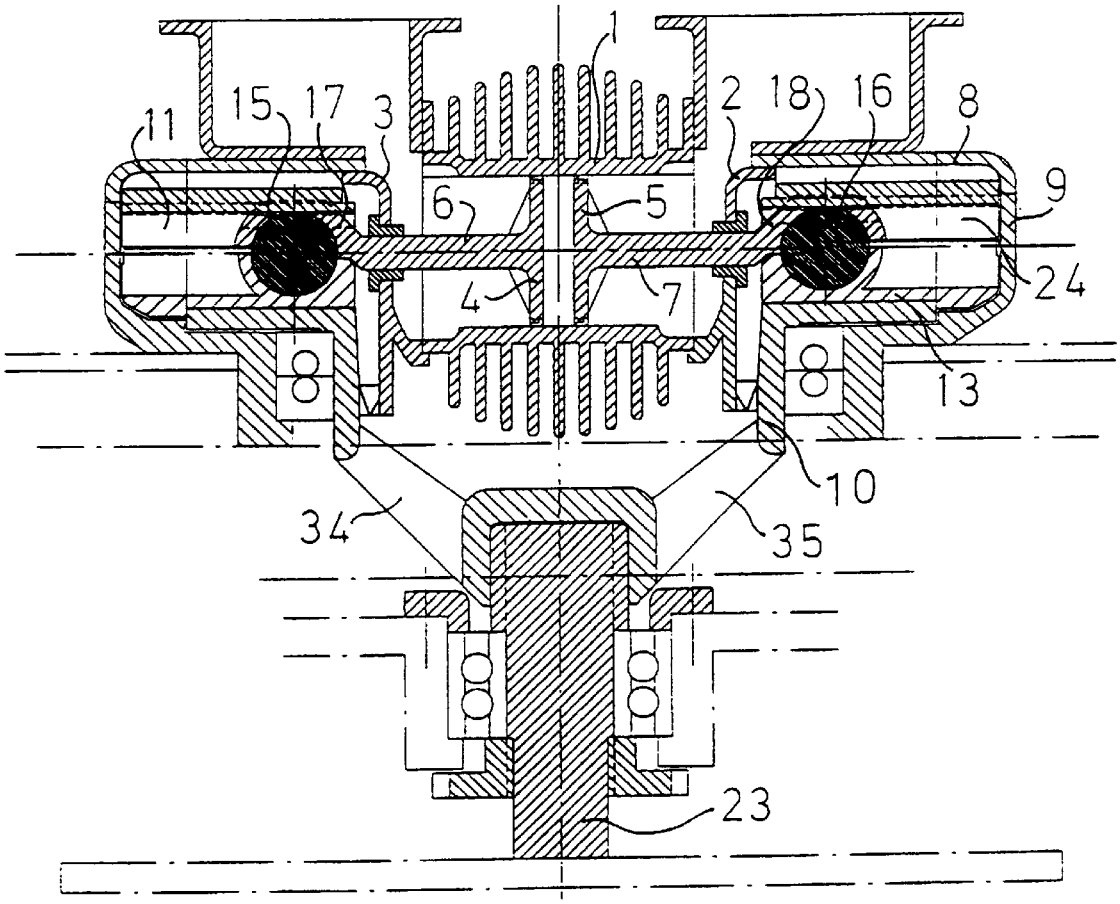
FIG. 2 shows the machine of FIG. 1 in cross section at right angle to FIG. 1.
Figure 3:
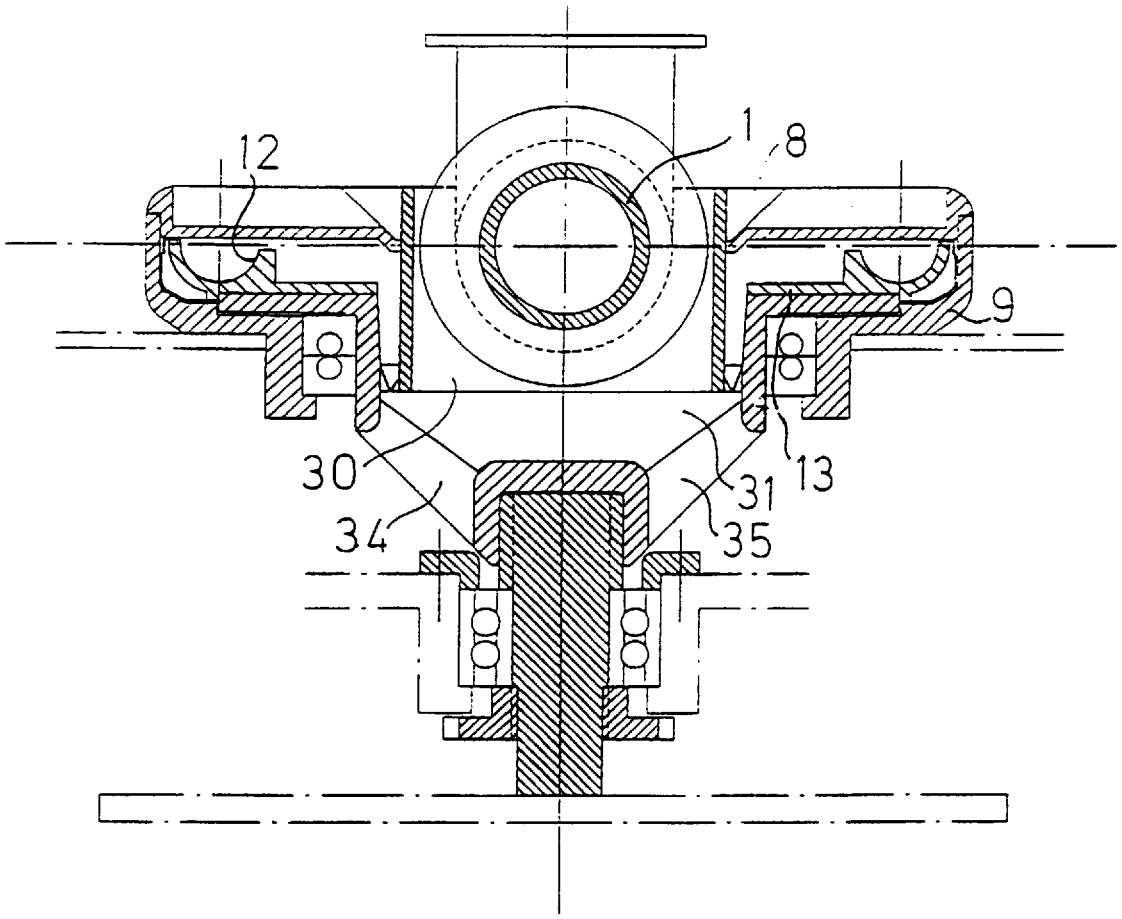
FIG. 3 shows the machine of FIG. 1 in cross section at right angles to FIGS. 1 and 2.
Figure 4:
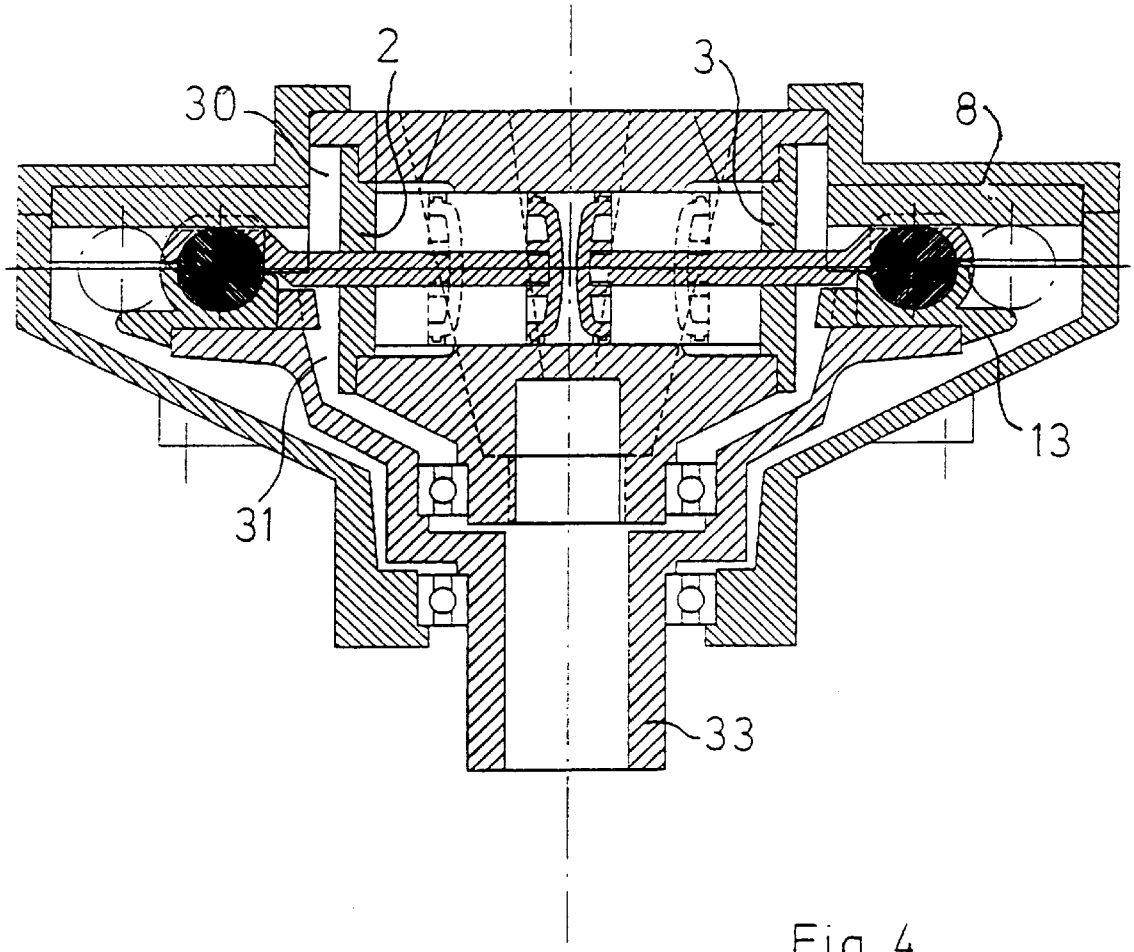
FIG. 4 shows another embodiment of the invention in a cross section corresponding to FIG. 2.

The device shown in the figures has two parallel plane discs, one which is named stationary disc 8 and one relatively thereto rotating disc 13. The stationary disc 8 is carried by a housing 9 and the disc 8 in turn carries in its centre a cylinder 1 having end walls 2, 3. In the cylinder there are two pistons 4, 5 which are working pistons, and in a combustion engine preferably have a common combustion space.

Fixedly joined to each of the piston 4, 5 is a piston rod 6, 7 which at its opposite end has a holder means 17, 18 for the ball 15, 16 by which the force from the to and fro motion is transmitted to the rotating disc 13. The balls 15, 16 also serve as bearings between the stationary disc 8 and the rotating disc 13. The rotating disc 13 is mounted onto a holder 10 which in turn is mounted onto an outgoing shaft 23 from which the rotating force is taken to be used for various purposes. In the preferred embodiment of the invention the centre axes of the cylinder bore coincides with the line of movement of the balls. The balls 15, 16 can move both in linear tracks 11, 24 in the fixed disc and in a common elliptic track 12 in the rotating disc.

Valves may be arranged adjacent to the upper dead centre, UDC, of the pistons at opposite sides in the centre of the cylinder bore. In the cylinder there are corresponding valve seats and the shafts are designed in consideration of the through bores and stearings which are in stationary parts closed to the cylinder. Preferably outer ends of the valve shafts directly contact a regulating curve or contact surface which is a part of the rotating disc.

Cooling of the cylinder is obtained by holes or channels 30, 31 arranged in both the rotating and the stationary discs and cooling air flows through these channels. In order to further improve the cooling the outside of the cylinder may have cooling fins, as shown in FIG. 1. In a preferred embodiment of the invention the conveyance of cooling air to or from the rotating disc is by means of a hollow shaft 33, which is connected to disc 13. The flow of air may take place either directly inside the shaft or inside a stationary tubular means mounted inside the shaft. This tubular means may be directly or indirectly joined to the stationary disc. Cooling air is directed to both sides of the cylinder and in those cases where the power machine is equipped with valves which are arranged mainly at right angle to the direction of movement of the pistons, four such cooling channels may be arranged. In other embodiments of the invention the means which connect the rotating disc and the outgoing shaft are so designed that they also function as fan blades 34, 35 and cause a desired air flow.

Figure 5:
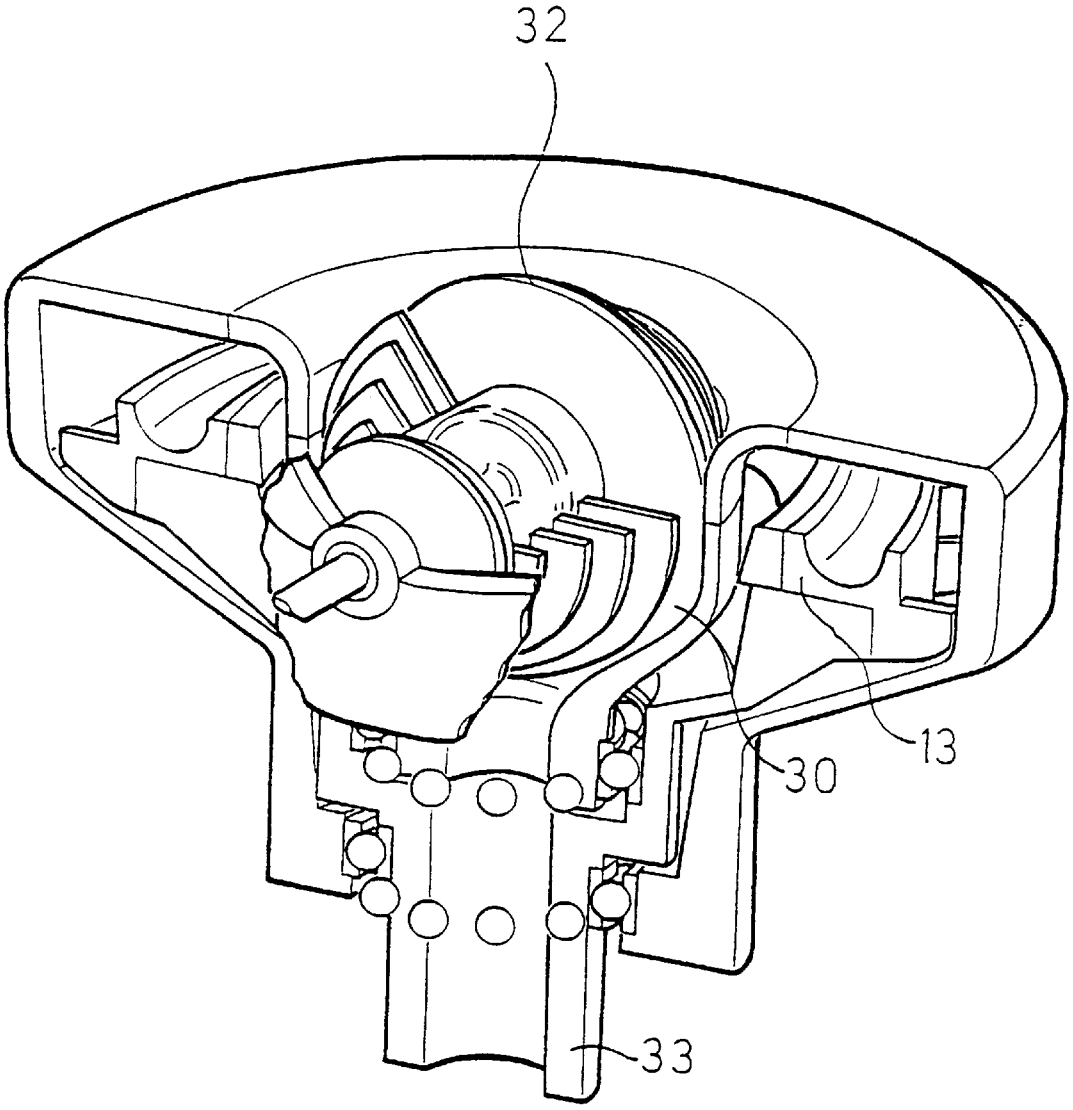
FIG. 5 is a perspective view of the invention with some parts removed and in partial cross section.

A preferred embodiment of the invention is shown in FIG. 5. Here the stationary disc is built together with, or forms a part of the housing which fully surrounds the rotating disc. All lubricated parts of the device are within this housing which downwards (according to FIG. 5) is delimited by an oil sealed bearing. The outgoing shaft from the rotating disc is hollow and cooling air is directed through the shaft to the inner bowl shaped volume wherein the cylinder having cooling flanges is positioned.

The airflow may in some applications be used also for other purposes than cooling only. When the power machine is used as a engine for lawn-mowers the airflow may be directed to the cut grass and affect this either to be blown to a collector at the lawn-mower or flow back to the knives to be cut into smaller pieces.

What is claimed is:

1. A power machine comprising:

a common cylinder having a bore formed therein;

two pistons disposed in said bore in opposed facing relation with respect to each other and being constructed and arranged to synchronously reciprocate within said bore in opposite respective directions; and a transmission mechanism for converting linear reciprocating movement of said two pistons into a rotating movement, said transmission mechanism comprising a stationary disc and a rotating disc, said rotating and stationary discs being arranged in generally parallel relation to one another and being operatively coupled to each other and to said two pistons to convert reciprocating movement of said pistons into rotation of said rotating disc, wherein said common cylinder is mounted within centrally-located openings formed in said stationary and rotating discs, said openings being positioned and configured to permit cooling air to pass through said openings and over an outer surface of said common cylinder.

2. The power machine according to claim 1, further comprising a housing constructed and arranged to fully surround said rotating disc, said stationary disc being fixedly attached to said housing.

3. The power machine according to either of claims 1 or 2, further comprising fan blades attached to and extending from said rotating disc to cause flow of cooling air during rotation of said rotating disc.

4. The power machine of claim 3, wherein a portion of each of said fan blades is attached to an output shaft to thereby rotationally couple said rotating disc to the output shaft.

5. The power machine according to claim 1, further comprising an output shaft rotationally coupled to said rotating disc, said output shaft being hollow so as to permit cooling air to flow therethrough.

* * * * *